US008857327B2

(12) United States Patent
Stefani et al.

(10) Patent No.: US 8,857,327 B2
(45) Date of Patent: Oct. 14, 2014

(54) STRUCTURE FOR PRESSES, IN PARTICULAR FOR FORMING CERAMIC PRODUCTS

(75) Inventors: Franco Stefani, Sassuolo (IT); Franco Gozzi, Formigine (IT)

(73) Assignee: System S.p.A., Fiorano Modenese (IT)

( * ) Notice: Subject to any disclaimer, the term of this patent is extended or adjusted under 35 U.S.C. 154(b) by 0 days.

(21) Appl. No.: 13/876,704

(22) PCT Filed: Oct. 11, 2011

(86) PCT No.: PCT/IB2011/054466

§ 371 (c)(1),
(2), (4) Date: Mar. 28, 2013

(87) PCT Pub. No.: WO2012/056347

PCT Pub. Date: May 3, 2012

(65) Prior Publication Data

US 2013/0206024 A1 Aug. 15, 2013

(30) Foreign Application Priority Data

Oct. 28, 2010 (IT) ..... MO2010A0301

(51) Int. Cl.

| | |
|---|---|
| ***B30B 15/04*** | (2006.01) |
| ***B28B 3/02*** | (2006.01) |
| ***B30B 5/04*** | (2006.01) |

(52) U.S. Cl.

CPC ..... *B28B 3/02* (2013.01); *B30B 15/048* (2013.01); *B30B 5/04* (2013.01)

USPC ..... 100/214; 100/269.17; 425/77; 425/408; 425/411; 425/419; 425/450.1

(58) Field of Classification Search

USPC ..... 100/269.17, 214; 72/455; 425/77, 406, 425/408, 411, 419, 450.1

See application file for complete search history.

(56) References Cited

U.S. PATENT DOCUMENTS

| | | | | |
|---|---|---|---|---|
| 3,064,558 | A * | 11/1962 | Von Platen Baltzar | 100/214 |
| 3,563,167 | A | 2/1971 | Pennell et al. | |
| 4,155,476 | A * | 5/1979 | Lipiec et al. | 425/77 |
| 7,160,092 | B2 * | 1/2007 | Stefani | 425/77 |
| 2004/0261489 | A1 | 12/2004 | Stefani | |

FOREIGN PATENT DOCUMENTS

| | | |
|---|---|---|
| EP | 1 118 456 A1 | 7/2001 |
| EP | 1 441 899 A1 | 8/2004 |
| WO | 03/039846 A1 | 5/2003 |

* cited by examiner

*Primary Examiner* — Jimmy T Nguyen
(74) *Attorney, Agent, or Firm* — Pearne & Gordon LLP

(57) ABSTRACT

A structure for presses, a resistant structure of which includes at least a resistant element which, in turn, includes an annular element or arch, internally of which are predisposed two facing surfaces, between which at least a power organ is insertable, which power organ is suitable for compressing an object or material to be pressed between two bodies. Full-thickness cuts are symmetrically arranged at ends of the facing surfaces, each cut, starting from the end of the relative facing surface, develops over an arc of a polycentric curve which exhibits at least a first tract, the most external surface of which connects with the lateral surface of the vertical portion of the annular element or arch, and at least a second tract which is connected to the first tract and extends over a portion of not less than a quarter of an arc of circumference.

10 Claims, 2 Drawing Sheets

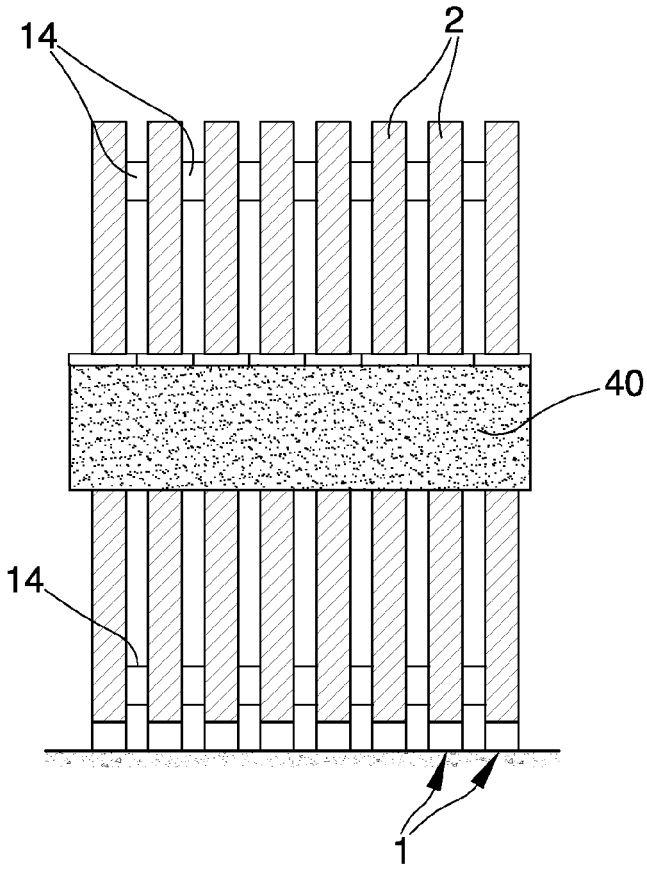
Fig. 2
Fig. 3
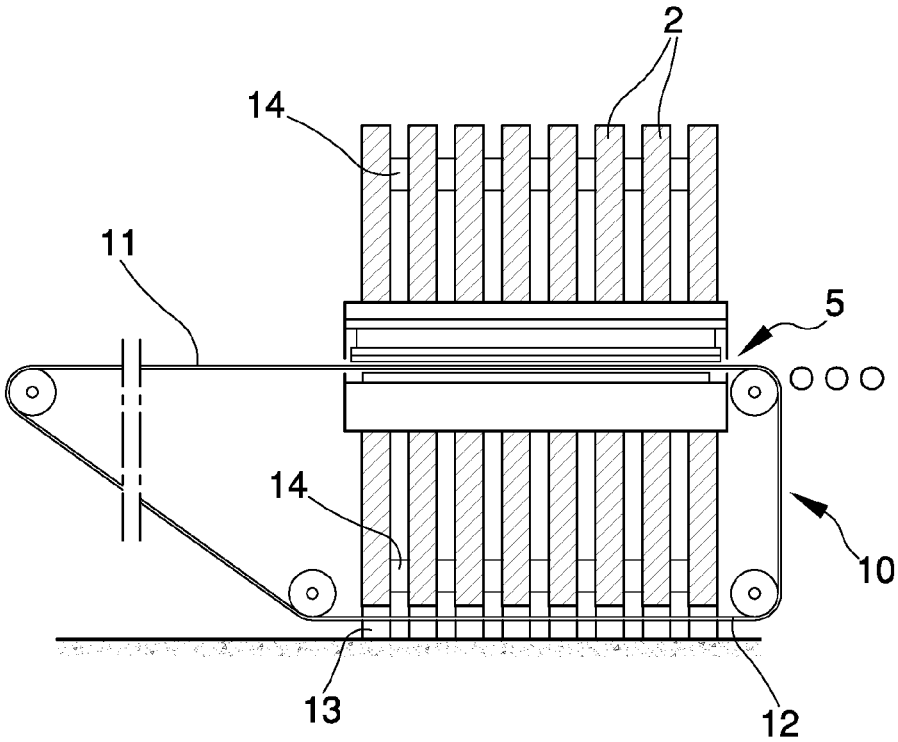

STRUCTURE FOR PRESSES, IN PARTICULAR FOR FORMING CERAMIC PRODUCTS

CROSS REFERENCE TO RELATED APPLICATIONS

This application is a National Stage of International Application No. PCT/IB2011/054466 filed Oct. 11, 2011, claiming priority based on Italian Patent Application No. MO 2010A000301 filed Oct. 28, 2010, the contents of all of which are incorporated herein by reference in their entirety.

TECHNICAL FIELD

The invention relates to a structure for presses, in particular for forming ceramic products.

The field of use of the invention is very general and certainly comprises all possible applications in which a plastic forming or deforming by pressing with a preferably vertical direction of application of the force has to be carried out.

Specifically, though not exclusively, it is usefully applied in the forming of ceramic products, in particular slabs and tiles.

BACKGROUND ART

Various types of vertical hydraulic press for forming ceramic tiles are known, which exhibit a structure or frame, which connects the mobile and fixed parts to one another, which has to be particularly rigid and, in the example, takes on the typical closed frame shape, normally with two uprights with accessibility to the work plane from two opposite sides. Commonly these ceramic tile-forming presses exhibit a free space between the two uprights or columns (which defines the inlet mouth of the material to be formed) that is very large, indeed as large as possible. This space is in fact dimensioned on the basis of the largest dimension of the pressing rectangle which represents the flat surface on which the pressing action will be performed, necessarily discontinuously and intermittently.

This fact, of having a large introduction space to which a decidedly smaller depth usually corresponds, is largely induced by the need to render the run of the usual loading carriage of the powder material as small as possible, essentially with the aim of not overly penalizing the rhythm of production. Consequently to the considerable space between the two uprights or columns, in the known realizations of oldest date the resistant structure of the press develops in the perpendicular plane to the inlet direction of the material to be formed. This structure is therefore rather large and tall—so tall as to require, in some cases, a partial interment having the aim of giving the structure the required stability.

The height of these structures is substantially due to the usual constructional technique which comprises use of a base and an upper crossbar, connected by the uprights or columns, which must be of considerable thickness—in the vertical direction—in order to guarantee the two planes supporting the reactions deriving from the application of the pressing force an accentuated undeformability: these are in fact the planes on which the lower and upper parts of the die act.

By way of example, in hydraulic presses used for forming ceramic tiles able to exert a pressing force of 7000 tonnes and with a free space between the uprights or columns of greater than 2 meters, the structure can reach heights of greater than 7 meters, of which about a third is interred.

In consideration of the forces in play, in order to guarantee these known structures those characteristics of deformability which enable them to be adapted in part to any loading defects in the powders to be pressed, various technical solutions have been adopted, including some which are constructionally complex but which are nevertheless not fully satisfactory.

In particular the present applicant has provided interesting technical solutions which are the objects of publications EP 1118456 and EP 1441899. These solutions, which are able to provide good responses to the main above-cited problems in the prior art, exhibit a modular structure composed by a plurality of resistant elements that are assemblable in series, one consecutively to another with an arrangement and a modular organisation with which the variation in the number of the resistant elements 1 assembled enables a proportional variation in the maximum pressing force that can be borne.

Us publication U.S. Pat. No. 3,563,167 discloses a frame of a press composed of a certain number of flat sub-frames, each of which defines an opening. The sub-frames are interconnected by means of plates and maintained distanced from one another.

For all of these realizations it is important and determinant to comprise resistant elements in the form of ring-closed arches which must guarantee the necessary resistance for a high number of cycles without any structural yielding or the beginnings of such occurring.

The present invention is directed principally to a considerable improvement of the characteristics or resistance to fatigue of the known applications. With this, the invention is aimed at guaranteeing a working life of the resistant elements of the presses that is in line with the working life expected for the plants in which the presses themselves are inserted.

Further, some of the realizations actuated in conformity with the inventions of the cited publications are characterised by a relatively complicated construction, mainly caused by the components to be assembled.

The main aim of the present invention is to obviate the limitations in the prior art, by disclosing a compact, light and simple press in terms of constitution and assembly, which is structured in line with a modular concept.

An advantage of the invention consists in the fact of presenting a structure which, given an equal maximum-applicable compression force, is characterised by considerable lightness and a very contained overall size.

A further advantage of the invention consists in being constructionally very simple in general, in particular as far as the structure of the resistant elements or arches are concerned, as well as in relation to the number of components and the assembly mode thereof.

These aims and advantages and others besides are all realised by the present invention, as it is characterised by the claims as set out herein below.

BRIEF DESCRIPTION OF THE DRAWINGS

Further characteristics and advantages of the present invention will better emerge from the detailed description that follows of an embodiment of the present invention, illustrated by way of non-limiting example in the accompanying figures, in which:

FIG. 2 is a schematic section performed along a vertical median plane in which the axis X-X represents the line in FIG. 1, with some parts not represented in order to evidence others;

FIG. 3, in the same section as in FIG. 2, shows an application of the invention to the plant for forming ceramic products (slabs) in line.

DETAILED DESCRIPTION OF THE INVENTION

Figure 1:
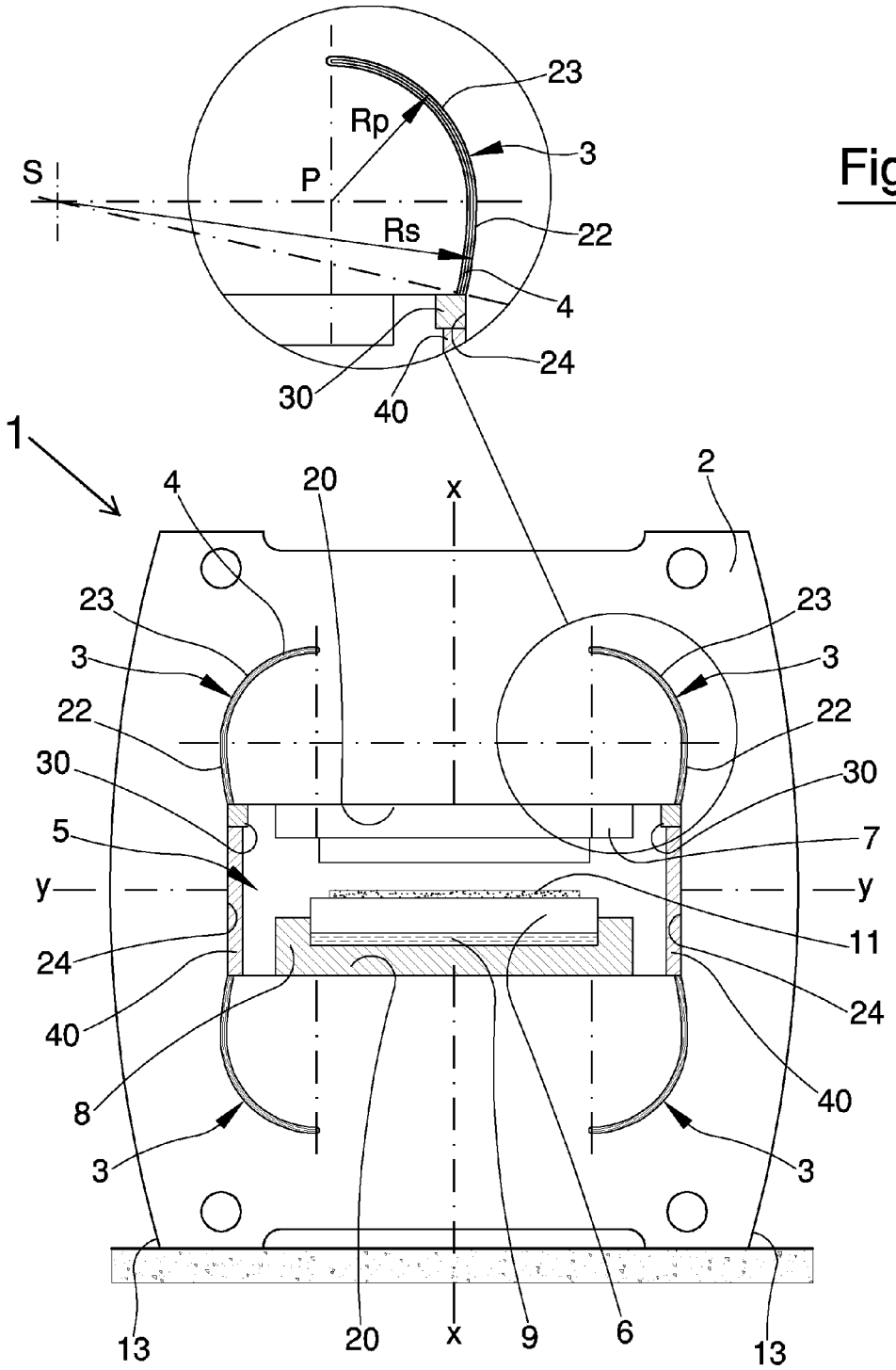
FIG. 1 is a schematic frontal view in vertical elevation.

With reference to the above-mentioned figures, 1 denotes in its entirety a resistant element 1 which, in turn, is constituted by a monolithic annular element or arch 2, which is flat, as it is fashioned with a suitable profiling from a large-thickness sheet.

The internal space of the annular element or arch 2 is in part delimited by two facing surfaces 20 which are located in diametrically opposite positions and between which at least a power organ 5 can be inserted, which power organ 5 is destined to exert the pressing action by compressing, between two bodies, the object or the material to be pressed such as to unload on the facing and parallel surfaces 20 the equal and opposite reactions of the pressing action. Normally these reactions unload between the facing surfaces 20 of a plurality of resistant elements 1 that are consecutively arranged such as to form the overall structure of the press (see FIGS. 2 and 3).

Constructionally the annular element or arch 2 is fashioned from a single slab or single sheet, normally made of steel, which is appropriately cut to a precise shape which is symmetrical at least with respect to a vertical median plane of which the axis X-X represents a trace.

The special conformation of each annular element or arch 2 includes full-thickness cuts 3 starting from the ends of the facing surfaces 20.

Each full-thickness cut 3 exhibits a predetermined width and, starting from the corresponding end of the relative facing surface 20, develops over a polycentrically-curved arch which exhibits at least a first tract 22 the most external surface of which connects to the lateral surface 24 of the vertical or nearly-vertical portion of the annular element or arch 2 which laterally delimits the space internally of which the power organ 5 is housed.

At least a second tract 23 of each full-thickness cut 3 is connected to the first tract 22 and exhibits a concavity which has the same direction as that of the first tract 22.

The second tract 23 preferably has an arc-of circle shape and extends over a portion of not less than a quarter of an arc of circumference.

The full-thickness cuts 3 are arranged symmetrically with respect to the median axis X-X of the annular element or arch 2 which is perpendicular to the facing surfaces 20 and has a vertical lie.

Overall the annular element or arch 2 has a symmetrical conformation, with the exception of the lower ground-resting part, and also with respect to a median axis Y-Y that is parallel to the facing surfaces 20.

Each full-thickness cut 3 is specially made for housing internally thereof at least a plate 4 provided with opposite surfaces destined to come into contact with the reciprocally-facing surfaces delimiting the full-thickness cut 3.

The opposing surfaces of the sheet 4 and the surfaces delimiting each full-thickness cut 3 are smooth and in any case characterised by a low coefficient of friction.

In particular, these surfaces, which are destined to come into reciprocal contact, are lubricated with the aim of enabling relative sliding when under load, even of a small entity, without considerable tangential actions being unleashed.

In practice the illustrated situation serves to allow (small) relative displacements between the two facing surfaces delimiting each full-thickness cut 3, limiting as much as possible the reciprocal interaction and normal surface stresses transmitted to and by the plate 4, thus contributing to a distributing of the loads that is as uniform as possible in the zones of the annular element or arch 2 that are under the greatest stress.

For this reason the facing surfaces which come into reciprocal contact are lubricated with lubricants of a type based on molybdenum bisulphide or the like, such as for example the product commercially known as MOLYCOTE®-3321R.

In order to further improve the effect, internally of each full-thickness cut 3 a plurality of thin plates 4 are housed, arranged such as to form a sort of pack in which each of the plates located internally thereof is provided with opposite surfaces destined to come into contact with the surfaces of the adjacent plates, while the external plates of the pack exhibit external surfaces that are destined to come into contact with the surfaces delimiting each full-thickness cut 3. All the reciprocally-facing surfaces in contact are lubricated with lubricants based on molybdenum bisulphide or the like.

Each full-thickness cut 3 is essentially shaped as a polycentric curve constituted by at least two reciprocally-connected arches: the first tract 22, the most external surface of which connects with the lateral surface 24 of the vertical or nearly-vertical portion of the annular element or arch 2 which laterally delimits the space internally of which the power organ 5 is housed; the second tract 23 which is connected to the first tract 22 has an arc-of-circle shape and extends over a portion of not less than a quarter of an arc of circumference. In particular this second arched tract 23 develops starting from the connection with the first tract 22 up to the intersection with the vertical, parallel to the axis X-X, passing through the centre of the circle of which the arched tract 23 forms a part.

The first tract 22 is an arc of circle portion the radius of which, denoted by Rs, is greater than the radius Rp of the arc of circle of the second tract 23 (from two to four times larger, preferably Rp/Rs=0.345).

The entity of the arc of circle relating to the first tract 22 is comprised between 10° and 15°.

The entity of the arc of circle relating to the second tract 23 is about 90°.

The centres of the circumferences to which the arcs of the tract 22 and the tract 23 belong, respectively denoted by S and P, are located on a same horizontal axis parallel to the median axis Y-Y.

Purely by way of example, with an overall height (comprising the rest feet) of the annular element or arch 2 of about 2200 mm, and a distance between the facing surfaces 20 of about 530 mm, the full-thickness cut 3 exhibits: the radius of the external surface of the first tract 22 of about 870 mm, the radius of the external surface of the second tract 22 of about 300 mm and a thickness of about 20 mm. The relative surfaces, comprising those of the plates 4, exhibit a surface roughness of about 1.2 Ra.

The geometry indicated by the full-thickness cuts 3 produces, as a characteristic consequence, the fact that the distance between the vertical surfaces 24 which laterally delimit the compartment internally of which the power organ 5 is housed is slightly smaller than the maximum distance, measured along the horizontal axis identified by the centres of the arcs of the second tract 23 arranged symmetrically with respect to the axis X-X, between the external surfaces of the second tracts.

The overall structure of the press includes the assembly of a plurality of resistant elements 1 arranged facing and aligned consecutively at a predetermined distance from one another, obtained using appropriate spacers.

The resistant elements 1 and in particular the annular elements or arches 2 are assemblable with an arrangement and a modular organisation by virtue of which the variation in the number of the resistant elements 1 assembled enables proportionally varying the maximum-bearable pressing force.

The spacing of the annular elements or arches 2 can be realised using spacers 14 located between the facing surfaces of any two consecutive annular elements 2. Such spacers operate only in a perpendicular direction to the annular elements or arches 2 without constituting a constraint to relative displacements in a parallel direction to the elements.

The pressing action is exerted by the power organ 5 which operates between the facing surfaces 20. This organ, in the illustrated embodiment, is constituted by a lower body 6 and an upper body 7, between which the objects or the material to be pressed can be inserted, and by a hydraulic actuator which in turn comprises, on a base 8, a chamber 9, into which pressurised fluid is sent. The chamber 9 is superiorly sealedly closed by the lower body 6 which functions as a piston.

The base 8 and the upper body 7 are rested in contact with the facing surfaces 20 present on the resistant elements 1 reciprocally assembled arranged facing and consecutively aligned at a predetermined distance from one another.

In particular, the pressing action is actuated by sending pressurised fluid into the chamber 9 and can be performed on the powder-form material predisposed on the upper branch 11 of a loop-wound conveyor belt 10. The upper branch 11 longitudinally crosses the whole press and exhibits a part upstream of the press, where it constitutes the support on which the loads of powder destined to press-forming are prepared, and a downstream part, at which it functions as a conveyor for evacuating the products (slabs). In the central part, comprised between the upstream and downstream parts, the branch 11 is comprised between the lower body 6 and the upper body 7 against which the powder material is compressed and formed during the pressing action. During this operation, the portion of branch 11 involved functions as a lower closure of the die.

The return of the conveyor belt 10 is realised via the lower branch 12 which is housed freely below the body of the press, between the two rest feet 13 each resistant element 1 is provided with and which are fashioned in a single piece with the corresponding annular element 2.

The structure of the press of the invention is free of welding and bolting.

The joining and alignment of the resistant elements 1 are realised using known means which, very schematically, comprise the use of two spacers 40 having an overall parallelepiped shape, which are interposed such as to interact between the ends of the facing surfaces 20, such that between them and the remaining parts of the facing surfaces 20 a compartment is identified, internally of which the whole power organ 5 is housed.

The interposing of the spacers 40 is actuated such as to realise a predetermined forcing between the ends of the facing surfaces 20 when the press is not under load, such as to guarantee the alignment of the annular elements or arches 2. For this purpose, pre-loading wedges 30 can be used, independently and very simply activatable using screw-threaded tie-rods until the predetermined pre-load value is reached. The pre-load value is determined such that when the press is functioning the reaction stress to the material pressing, shared among the single resistant elements, totally annuls any forcing of the spacers.

In fact, the pre-loading has a double function: it keeps the machine together and makes the structure absolutely rigid with the machine inactive, and in the first pressing stage, i.e. up to when the overall value of the pressing force exceeds the pre-load value. This possibility, obtainable with very simple regulations, is particularly important in powder pressing for forming slabs and tiles because it enables adaptation of the pressing action to the variation in the behaviour of the material (prevalently plastic in the initial stage, prevalently elastic in the final stage).

In this context, the particular geometry of the full-thickness cuts 3 present in the annular elements or arches 2 distributes, gradually and quite uniformly, the tensions induced in the material in the zones at greater risk of concentration, thus enabling not only an optimisation of the resistance to fatigue, but also a better exploitation of the material itself (with a further reduction in weight, etc.).

All of the above is achieved without further parts and components beyond the packs of plates 4 inserted internally of the full-thickness cuts 3.

The invention claimed is:

1. A structure for presses for forming ceramic products, comprising: a resistant structure constituted by at least one resistant element (1) which, in turn, comprises a flat annular element or arch (2), internally of which are predisposed two facing surfaces (20), diametrically opposite one another, between which at least a power organ (5) is inserted, which power organ (5) is destined to exert a pressing action by compressing an object or material to be pressed between two bodies to unload on the facing surfaces (20) equal and opposite reactions of the pressing action; full-thickness cuts (3) being provided at the ends of the facing surfaces (20), wherein each full-thickness cut (3) exhibits a predetermined width and starting from the end of the relative facing surface (20) develops over a curved portion which exhibits at least a first tract (22) a most external surface of which connects with a lateral surface (24) of a vertical or nearly-vertical portion of the annular element (2) or arch which laterally delimits a space internally of which the power organ (5) is housed, and at least a second tract (23) which is connected to the first tract (22) and exhibits a concavity which has the same direction as the first tract (22); the full-thickness cuts (3) being arranged symmetrically at least with respect to a median vertical axis of the annular element (2) or arch which is perpendicular to the facing surfaces (20); at least a plate (4) being housed in each full-thickness cut (3) which plate (4) is provided with opposite surfaces that are destined to contact reciprocally-facing surfaces which delimit each full-thickness cut (3).

2. The structure for presses of claim 1, wherein each full-thickness cut (3), starting from an end of the relative facing surface (20) develops in a polycentric curve in which the second tract (23), which is connected to the first tract (22), has a circular arc shape and extends over a portion of not less than a quarter of an arc of circumference.

3. The structure for presses of claim 1, wherein the opposite surfaces of the at least a plate (4) and the corresponding reciprocally-facing surfaces which delimit each full-thickness cut (3) in which the plate (4) is housed are smooth and in any case characterised by a low coefficient of friction.

4. The structure for presses of claim 3, wherein the opposite surfaces of the at least a plate (4) and the corresponding reciprocally-facing surfaces which delimit each full-thickness cut (3) in which it is housed are lubricated.

5. The structure for presses of claim 4, wherein the opposite surfaces of the at least a plate (4) and the corresponding reciprocally-facing surfaces which delimit each full-thickness cut (3) in which the plate (4) is housed are lubricated using lubricants based on molybdenum disulphide.

6. The structure for presses of claim 1, wherein the at least a plate comprises a plurality of plates (4) which are housed internally of each full-thickness cut (3), which plurality of plates (4) are arranged to form a sort of pack, the external plates (4) of the pack being destined to come into contact with the reciprocally-facing surfaces delimiting each full-thickness cut (3); all the reciprocally-facing and contacting surfaces being lubricated with lubricants based on molybdenum disulphide.

7. The structure for presses of claim 6, wherein each full-thickness cut (3) is essentially shaped as a polycentric curve constituted by at least two reciprocally-connected tracts of arc: the first tract (22) exhibiting an external-most surface connected with the lateral surface (24) of the vertical or nearly-vertical portion such that the annular element (2) or arch delimiting a space internally of which the power organ (5) is housed; the second tract (23), connected to the first tract (22), is arch-shaped and extends over a portion of not less than a quarter of an arc of circumference; the second tract (23) developing starting from the connection with the first tract (22) up to the intersection with the vertical, parallel to an axis X-X, passing through the centre of the arc of which the second tract (23) is a part.

8. The structure for presses of claim 6, wherein the first tract (22) is a portion of an arc of circle, a radius (Rs) of which is greater than a radius (Rp) of an arc of circle of the second tract (23) and extends for an angle comprised between 10° and 15°.

9. The structure for presses of claim 8, wherein the centres (S, P) of the circles to which both the arches of the first tract (22) and the second tract (23) belong are located on a same horizontal axis which is parallel to a median axis (Y-Y).

10. The structure for presses of claim 1, wherein the at least a resistant element comprises a plurality of resistant elements (1) which are assemblable in series one consecutively to another, with a modular arrangement, such that a variation in a number of the assembled resistant elements (1) enables a maximum bearable pressing force to be proportionally varied.

* * * * *